US007878869B2

(12) United States Patent
Murano et al.

(10) Patent No.: US 7,878,869 B2
(45) Date of Patent: Feb. 1, 2011

(54) CONNECTING MEMBER WITH A RECEPTACLE AND AN INSERTION TERMINAL OF A SHAPE DIFFERENT THAN THAT OF THE RECEPTACLE

(75) Inventors: Hiroaki Murano, Tokyo (JP); Tomokazu Matsumoto, Tokyo (JP); Yoshikazu Tanaka, Tokyo (JP); Tetsu Hirose, Tokyo (JP)

(73) Assignee: Mitsubishi Cable Industries, Ltd., Tokyo (JP)

( * ) Notice: Subject to any disclaimer, the term of this patent is extended or adjusted under 35 U.S.C. 154(b) by 0 days.

(21) Appl. No.: 12/301,761

(22) PCT Filed: May 23, 2007

(86) PCT No.: PCT/JP2007/060528

§ 371 (c)(1),
(2), (4) Date: May 4, 2009

(87) PCT Pub. No.: WO2007/136092

PCT Pub. Date: Nov. 29, 2007

(65) Prior Publication Data

US 2009/0318002 A1 Dec. 24, 2009

(30) Foreign Application Priority Data

May 24, 2006 (JP) ..... 2006-144254

(51) Int. Cl.
*H01R 11/03* (2006.01)
*H01R 4/36* (2006.01)

(52) U.S. Cl. ..... 439/792; 439/810

(58) Field of Classification Search ..... 439/792, 439/189, 810, 797, 510, 274
See application file for complete search history.

(56) References Cited

U.S. PATENT DOCUMENTS

| | | | | |
|---|---|---|---|---|
| 4,345,806 | A * | 8/1982 | McHenney | 439/510 |
| 5,106,318 | A | 4/1992 | Endo et al. | |
| 5,203,724 | A * | 4/1993 | Casey | 439/792 |
| 6,036,554 | A * | 3/2000 | Koeda et al. | 439/797 |
| 6,991,493 | B2 * | 1/2006 | Matsui et al. | 439/579 |
| 7,527,523 | B2 * | 5/2009 | Yohn et al. | 439/564 |
| 2010/0062627 | A1 * | 3/2010 | Ambo et al. | 439/189 |

FOREIGN PATENT DOCUMENTS

| | | | |
|---|---|---|---|
| JP | 4-27587 | U | 3/1992 |
| JP | 8-335476 | A | 12/1996 |
| JP | 2005-071614 | A | 3/2005 |

OTHER PUBLICATIONS

English Language International Search Report dated Aug. 14, 2007 issued in parent International Appln. No. PCT/JP2007/060528.

* cited by examiner

*Primary Examiner*—Chandrika Prasad
(74) *Attorney, Agent, or Firm*—Holtz, Holtz, Goodman & Chick, PC

(57) ABSTRACT

Provided is a connecting member by which an electric wire can be branched easily with high reliability. Receptacle connecting ends (2*a*) of a plurality of wire terminals (2) having wires (3) are inserted into a wire terminal inserting hole (1*a*) of a holder (1), then, a pin terminal (4*a*) is inserted into a pin terminal inserting hole (1*b*) of the pin terminal (4*a*). The pin terminal (4*a*) is inserted through a tubular contact (2*c*) of the receptacle connecting ends (2*a*) arranged in the pin terminal inserting hole (1*b*), and electricity is carried between the wire terminals (2) through the pin terminals (4*a*).

8 Claims, 5 Drawing Sheets

CONNECTING MEMBER WITH A RECEPTACLE AND AN INSERTION TERMINAL OF A SHAPE DIFFERENT THAN THAT OF THE RECEPTACLE

This application is a U.S. National Phase Application under 35 USC 371 of International Application PCT/JP2007/060528 filed May 23, 2007.

FIELD OF THE INVENTION

The present invention relates to a connecting member for use in wire harness circuits in automobiles.

BACKGROUND OF THE INVENTION

In wire harness circuits used in automobiles, it is often required to make one or more branch circuits from a main circuit. To this end there have been often used the following two branching systems, i.e. a splice joint system and a joint connector system. In the splice joint system, a part of an electrically insulating sheath covering a main wire is pealed off and a branch circuit wire is connected to an exposed part of the main circuit by clamping. The joint connector system is described in the following Patent document 1. In this joint connector system, clamp terminals are connected to ends of a main circuit wire and a branch circuit wire and these clamp terminals are connected to each other by means of a common joint connector.

Patent document 1: Japanese Patent Kokai 2005-71614

DISCLOSURE OF THE INVENTION

Problems to be Solved by the Invention

In the former splice joint system, it is necessary to carry out the connecting operation for every one to three wires, and therefore efficient working could not be performed. Particularly, after connecting branch circuits, efficient operation for making a harness is further affected. Moreover, since the connecting operation using clamp terminals could not be carried out easily on a manufacturing line, the splice joint system could not be effectively applied to a line production system.

The latter joint connector system has been developed to overcome the above mentioned drawbacks of the splice joint system. In the joint connector system, a joint operation could be performed on a harness manufacturing line, and thus a higher production yield could be attained as compared with the splice joint system. Moreover, in the joint connector system, a harness circuit can be corrected or changed simply. However, the number of parts such as connectors, cooperating common connectors, bus bars and connecting terminals is large, and therefore an assembly of a harness circuit requires a longer time.

Particularly, in the known joint connector system disclosed in the above Patent document 1, since a size of a joint connector is large, a branch wire could not be connected to a main wire at a desired position of the main wire. Then, it is necessary to extend the branch wire to such a point that a sufficient space for accommodating the joint connector could be obtained. This results in that the wire harness could not be miniaturized effectively.

That is to say, even in the joint connector system, many problems to be solved are included for a higher space saving factor, a higher operation efficiency and a reduction in the number of parts.

The present invention has for its object to provide a connecting member which can remove the above mentioned drawbacks and can efficiently perform a simple and reliable harness assembling operation.

Means for Solving the Problems

In order to attain the above mentioned object, according to the invention, a connecting member comprises a holder made of synthetic resin and having a plurality of wire terminal inserting holes and an insertion terminal inserting hole which crosses with said wire terminal inserting holes within the holder; wire terminals each having a receptacle connecting end at one end and an electric wire connected to the wire terminal at the other end; and an insertion terminal which is inserted into said insertion terminal inserting hole and is inserted into contacts of the receptacle connecting ends of the wire terminals inserted into said wire terminal inserting holes to connect said wire terminals to each other.

MERITS OF THE INVENTION

In the connecting member according to the invention, the wire terminals can be connected to each other simply by inserting the insertion terminal, and therefore structure is simple and a reliability of electrical connection can be improved. Moreover, the number of parts can be reduced as compared with the known joint connector system, the space factor and working efficiency can be improved and cost can be reduced.

Particularly when the connecting member according to the invention is applied to harness circuits of automobiles, a much more compact connection structure can be attained as compared with the known joint connector method, and a working time for assembling the harness circuits can be materially shortened.

Furthermore, since the connecting member according to the invention is small in size, the connecting member can be arranged at any desired position in the wire harness without extending a branch wire.

It should be noted that a waterproof structure could be easily realized, and therefore the connecting member according to the invention can be used at a place in which a waterproof structure is required.

EXPLANATION OF THE REFERENCE NUMERALS

1 holder
1*a* wire terminal inserting hole
1*b* pin terminal inserting hole
2 wire terminal
2*a* receptacle connecting end
2*b* clamping portion
2*c* tubular contact
2*d* circular hole
2*e* cut-out portion
2*f* seal clamping portion
3 electric wire
4 through pin
4*a* pin terminal
4*b* grip portion
4*c* middle portion
5,6 waterproof sealing member

BEST MODES OF THE INVENTION

Now the present invention will be explained in detail with reference to embodiments shown in the attached drawings.

Embodiment 1

Figure 1:
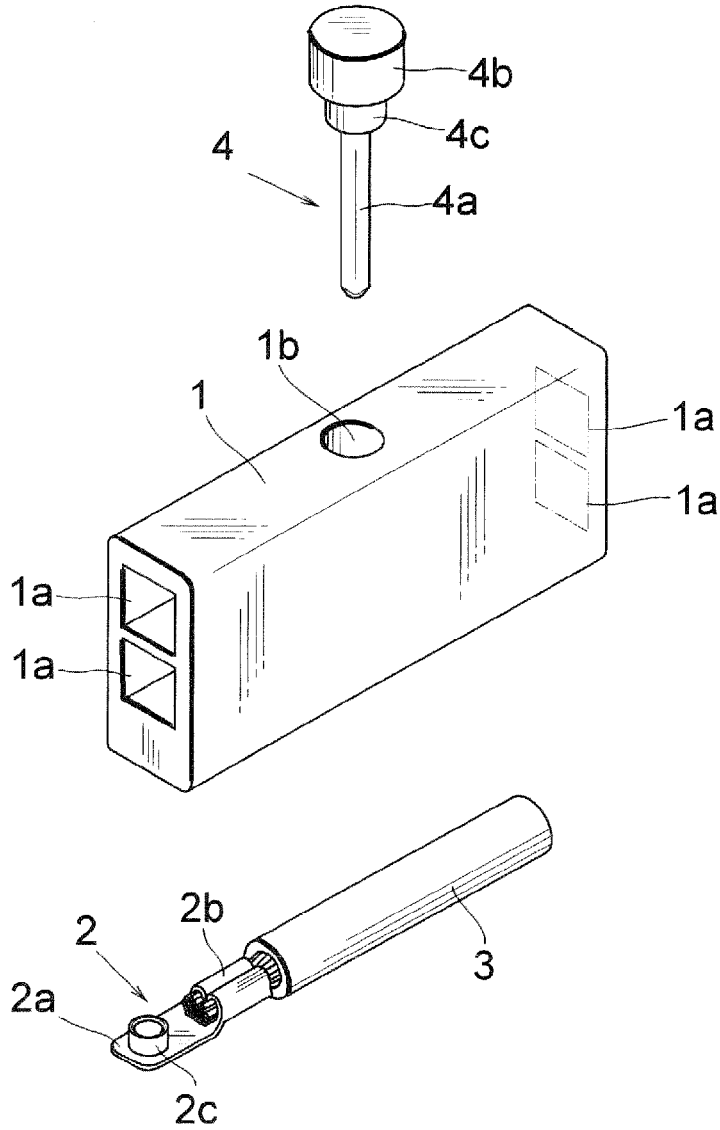
FIG. 1 is an exploded perspective view showing an embodiment 1 of the connecting member according to the invention.

In a first embodiment 1, as illustrated in an exploded perspective view of FIG. 1, the connecting member is mainly composed of a holder 1 made of electrically insulating synthetic resin and having a plurality of wire terminal inserting holes 1*a* and a pin terminal inserting hole 1*b*, a plurality of wire terminals 2 each having a receptacle connecting end 2*a* formed at a front end of the wire terminal 2 and a clamping portion 2*b* to which an electric wire 3 is connected, and a through pin 4 having a pin terminal 4*a*, grip portion 4*b* and a middle portion 4*c*.

A plurality of the wire terminal inserting holes 1*a* are formed in the holder 1 such that the wire terminal inserting holes 1*a* extends from right or left side walls of the holder 1 toward its center and a receptacle connecting end 2*a* can be inserted into the wire terminal inserting hole 1*a* to the given depth, and an inlet of each of these wire terminal inserting holes 1*a* has a rectangular shape. The pin terminal inserting hole 1*b* is formed to extend from a top wall of the holder 1 toward its center such that the pin terminal inserting hole 1*b* crosses with the wire terminal inserting hole 1*a* at right angles at a position of the receptacle connecting end 2*a* of the wire terminal 2.

The holder 1 may be made of a thermoplastic material such as polybutylene terephthalate (PBT) and polypropylene (PP) which have a higher thermal deformation temperature, a higher strength, an excellent electrically insulating property and a superior mechanical property. A size of the holder 1 may be suitably determined in accordance with sizes of electric wires to be used, and generally has a length of about 20 mm-150 mm.

The holder 1 may be generally manufactured by injecting a thermoplastic resin into a mold having a given configuration. If an inner configuration is too complicated, the holder 1 may be divided into a plurality of parts along longitudinal and/or lateral cross sections and molded parts may be assembled into a unit holder by cementing or engaging upon using the holder 1.

The wire terminal 2 may be formed by punching a single electrically conductive metal plate to form a metal strip and by folding the metal strip into the wire terminal. As shown in FIG. 1, at a front end of the wire terminal 2, there is provided the receptacle connecting end 2*a* in a shape of tongue, and a tubular contact 2*c* is provided at the receptacle connecting end 2*a*. The tubular contact 2*c* is formed by a drawing process into a tube having a short length. At a rear portion of the wire terminal 2 there is provided a clamping portion 2*b* and an end of the electric wire 3 is connected to the clamping portion 2*b*.

The wire terminal 2 may be manufactured by punching a copper or copper alloy plate into a metal strip having a given shape and by plating the thus punched out metal strip with Sn or by punching a copper or copper alloy plate having Sn coating plated thereon into a metal strip having a given shape. In view of mechanical strength and electrically conductivity, a brass plate may be preferably used. In this case, the brass plate may be preferably plated with Sn. Then, a corrosion resistant property is improved and a good electrical contact can be attained between the wire terminal 2 and the pin terminal 4*a*.

The tubular contact 2*c* may have any shape as long as an electrical contact can be attained with respect to the pin terminal 4*a*. Tapered guides may be preferably formed at both a root portion and a free end portion of the tubular contact 2*c*. Then, the pin terminal 4*a* may be inserted into the tubular contact 2*c* from any direction.

Figure 2:
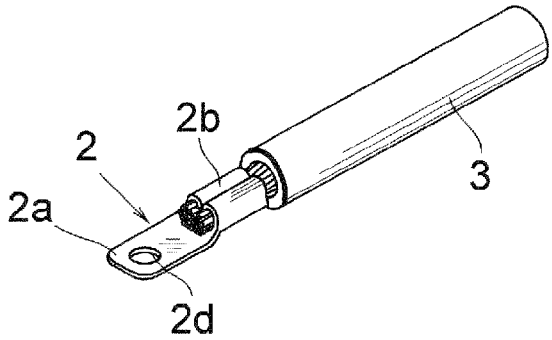
FIG. 2 is a perspective view depicting a modified embodiment of a wire terminal.
Figure 3:
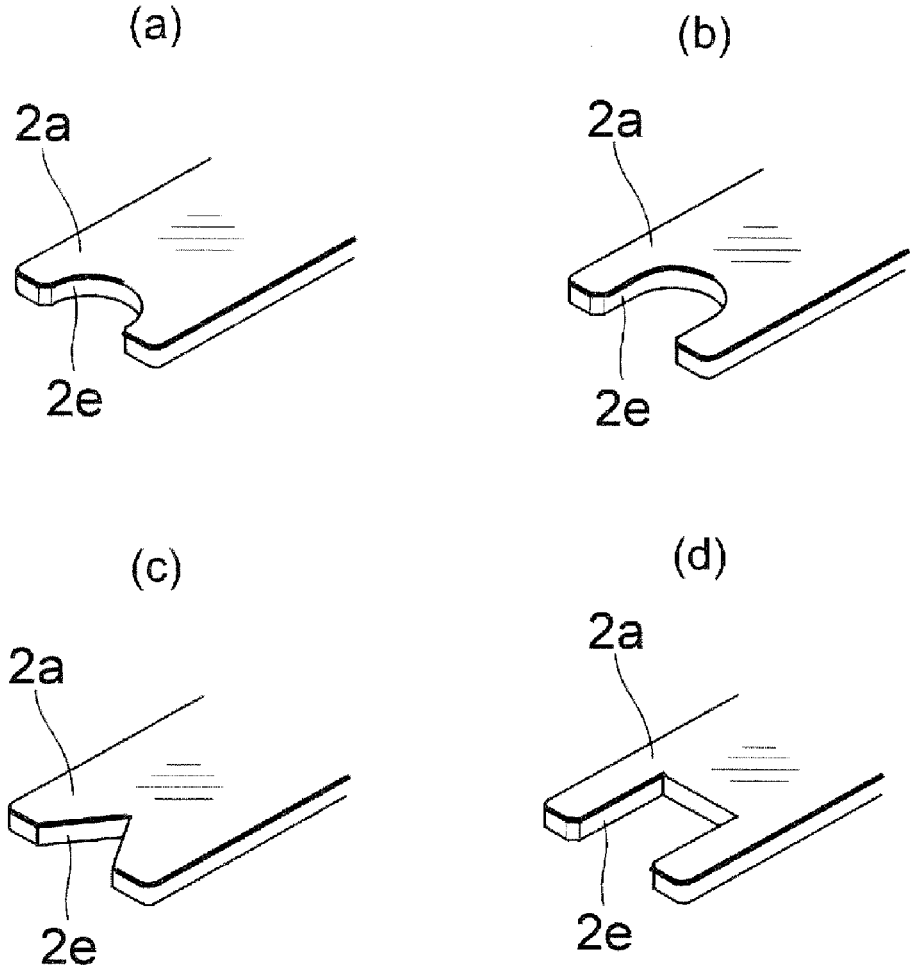
FIG. 3 is a perspective view illustrating a major parts of another embodiment of the wire terminal.

The tubular contact 2*c* may not have a circular cross sectional shape, but may have any desired cross sectional shape such as rectangular shape. FIG. 2 shows a modification of the tubular contact 2*c* in which only a circular hole 2*d* is formed in the receptacle connecting end 2*a* of the wire terminal 2. It should be noted that the hole 2*d* may not have a circular shape, but may have a triangular, rectangular or pentagonal shape. Alternatively, as illustrated in FIGS. 3(*a*)-3(*d*), cut-out portions 2*e* having various shapes may be formed in the receptacle connecting end 2*a*.

The electric wire 3 may be formed by an electrically insulated wire having a conductor and an electrically insulating sheath applied around the conductor and may have a conventional diameter. The conductor may be formed by a stranded wire of soft or hard copper wires which have been commonly used in automobile harnesses, or may be formed by a single wire or a stranded wire of copper alloy wires such as Cu—Sn alloy wire having a sufficiently large tensile strength and a small diameter. The electrically insulating sheath may be made of known electrically insulating materials. In view of environment protection, non-halogen insulating material may be advantageously used.

The electric wire 3 may be connected to the wire terminal 2 by conventional calking, welding, soldering or clamping. Among these connecting methods, the connection by the clamping portion 2*b* used in the present embodiment is preferable, because the clamping connection can be performed within a short time period and can attain a higher mechanical strength. It should be noted that a plurality of electric wires 3 may be connected to the clamping portion 2*b* of the wire terminal.

The pin terminal 4*a* of the through pin 4 is formed by a rod-like member made of an electrically conductive metal and connects receptacle connecting ends 2*a* of a plurality of wire terminals 2 to each other. The pin terminal 4*a* may have a circular cross sectional shape or a polygonal shape such as triangular shape, rectangular shape and pentagonal shape or a flat blade shape. It should be noted that the rectangular cross sectional shape is preferable as shown in the drawing, because the pin terminal 4*a* having the rectangular cross sectional shape can be easily manufactured, can be inserted without a large force, and can attain a stable and positive conduction. In this case, the contact of the wire terminal 2 may be preferably formed as the tubular contact 2*c* or circular hole 2*d*.

The pin terminal 4*a* is inserted into the contact formed in the receptacle connecting end 2*a*, while the contact is subjected to plastic deformation. Therefore, it is preferable that the pin terminal 4*a* has a cross sectional shape which can easily deform the contact. When the pin terminal 4*a* has a rectangular cross sectional shape, then the contact preferably has a circular cross sectional shape. Alternatively, when the pin terminal 4*a* has a circular cross sectional shape, then the contact has preferably a rectangular cross sectional shape.

It is preferable to make the pin terminal 4*a* harder than the receptacle connecting end 2*a* of the wire terminal 2, because the receptacle connecting end 2*a* is deformed by the insertion of the pin terminal 4*a* much more easily. The stiffness of the pin terminal 4*a* and receptacle connecting end 2*a* may be adjusted by suitably selecting manufacturing processes, thermal treatments and materials. Furthermore, in order to insert the pin terminal 4*a* into the tubular contact 2*c* formed at the receptacle connecting end 2*a*, a front end of the pin terminal 4*a* may be preferably formed into a conical shape, pyramid shape, truncated conical shape.

Figure 4:
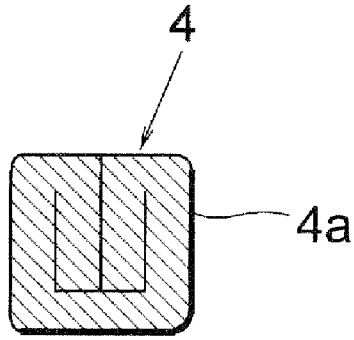
FIG. 4 is a cross sectional view showing a pin terminal.

The pin terminal 4*a* is formed by folding a metal strip to have a rectangular cross sectional shape as shown in FIG. 4. After that, a chip of the pin terminal 4*a* is deformed into a conical shape by pressing or cutting. When the pin terminal 4*a* is manufactured in this manner, even the pin terminal 4*a* having a small cross sectional area is hardly bent or broken.

Now it is assumed that the circular or tubular contact of the receptacle connecting end 2*a* has an inner diameter of d1 and the pin terminal 4*a* having a substantially rectangular cross section has a diagonal of x, then it is preferable to set d1<x.

It is assumed that the rectangular contact of the receptacle connecting end 2*a* has a side of d1 and the pin terminal 4*a* having a circular cross section has an outer diameter of d2, then it is preferable to set d1<d2.

Upon inserting the pin terminal 4*a* of the through pin 4 into the tubular contact 2*c* of the wire terminal 2, the through pin 4 has to be pushed with some force. To this end, the through pin 4 is provided with the tubular grip portion 4*b* made of an electrically insulating synthetic resin. Moreover, in order to fix the through pin 4 in the pin inserting hole 1*b*, the through pin 4 is provided with the middle portion 4*c*. The middle portion 4*c* has an outer diameter identical with an inner diameter of the pin terminal inserting hole 1*b*. Since the grip portion 4*b* has an outer diameter larger than an outer diameter of the middle portion 4*c*, the insertion depth of the through pin 4 in the pin terminal inserting hole 1*b* is limited by the grip portion 4*b*. In this manner, a user can easily judge whether or not the pin terminal 4*a* having a given length has been inserted into the pin terminal inserting hole 1*b* up to a predetermined position.

The grip portion 4*b* may be made of any electrically insulating synthetic resin, but is preferably made of a material which could not broken by the above mentioned force. For instance, the grip portion 4*b* may be preferably made of polybutylene terephthalate, polypropylene and polyethylene.

Figure 5:
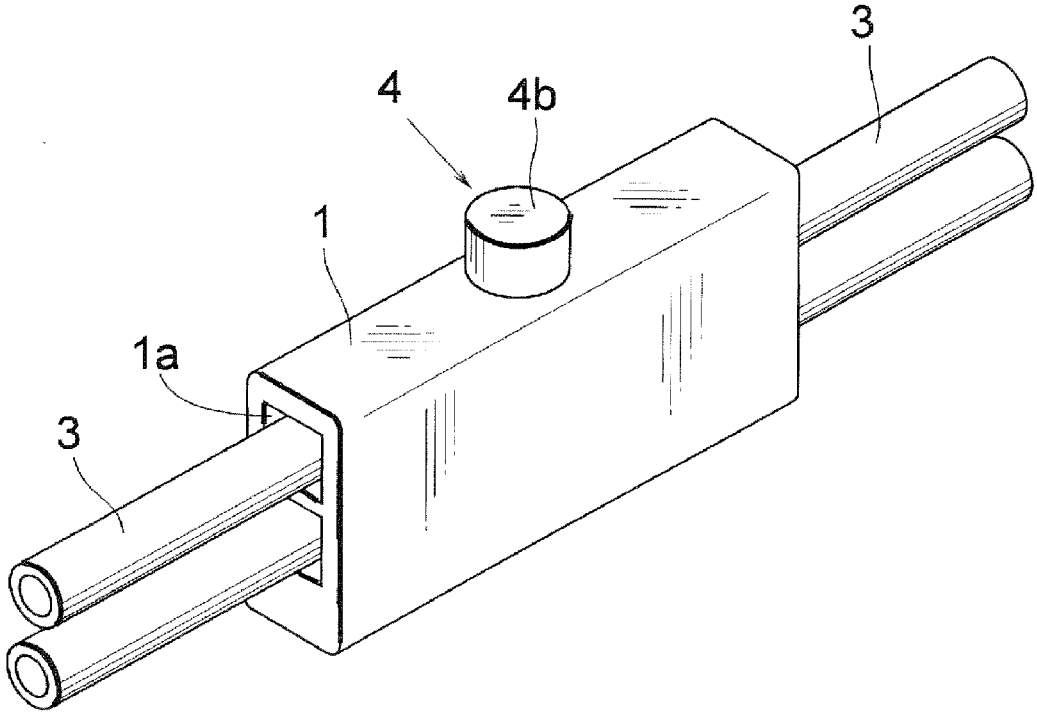
FIG. 5 is a perspective view representing an assembly.
Figure 6:
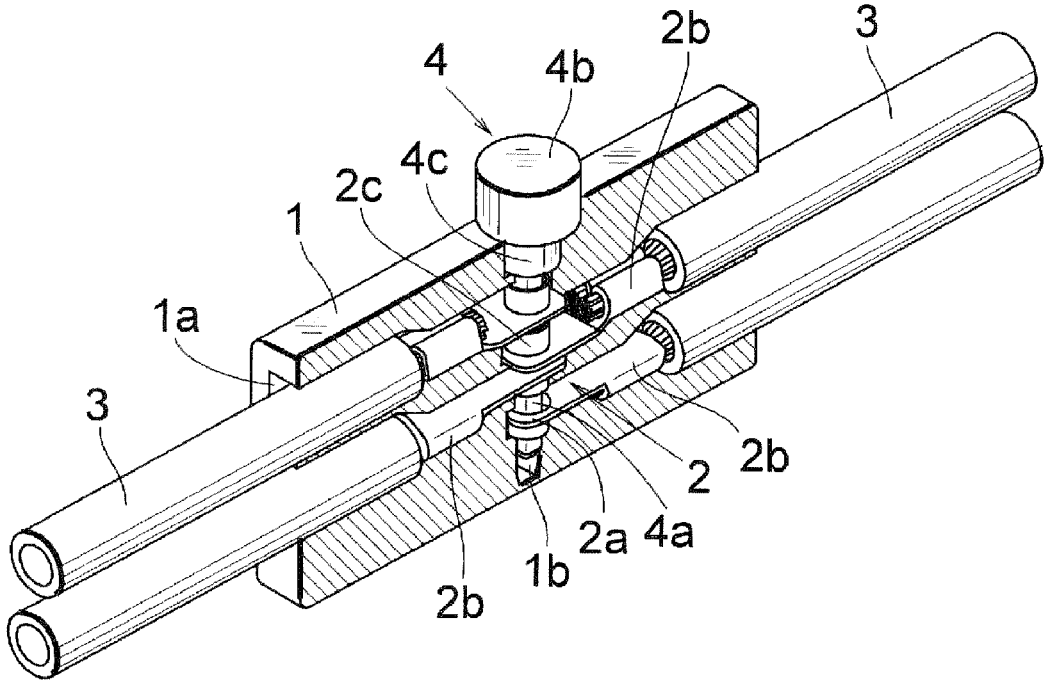
FIG. 6 is a partially cut-out perspective view showing the assembly.

FIG. 5 is a perspective view and FIG. 6 is a cross sectional view showing an assembly of the connecting member of the present embodiment. The four wire terminals 2 are inserted into respective wire terminal inserting holes 1*a* formed in the holder 1. As best shown in FIG. 6, the wire terminals 2 are inserted into such a position that a center axes of the tubular contacts 2*c* of the receptacle connecting ends 2*a* of the wire terminals 2 are aligned with a center axis of the pin terminal inserting hole 1*b*. It should be noted that the wire terminal inserting holes 1*a* on the right hand side are formed at a different level than the wire terminal inserting holes 1*a* on the left hand side such that the tubular contacts 2*c* are stacked one on another within the holder 1.

When the tubular contact 2*c* is provided at the receptacle connecting end 2*a*, upon insertion of the through pin 4 into the pin terminal inserting hole 1*b*, the through pin 4 has to be inserted with a correct posture. That is to say, if the through pins 4 are inserted with random posture, the tubular contacts 2*c* might not be regularly aligned at position within the holder 1. To this end, it is preferable to provide a suitable mark indicating a direction of the tubular contact 2*c* at an inlet of the wire terminal inserting hole 1*a*.

When the through pin 4 is inserted into the pin terminal inserting hole 1*b*, the pin terminal 4*a* is inserted into the tubular contacts 2*c* formed at the receptacle connecting ends 2*a* and the wire terminals 2 are electrically connected to each other. As long as the through pin 4 is not pulled out of the holder 1, the electrical connection of the wire terminals 2 is maintained.

The through pin 4 is preferably fixed to the holder 1. To this end, screw threads are cut on the outer surface of the middle portion 4*c* and on the inner surface of the pin terminal inserting hole 1*b*, and the through pin 4 is screwed into the pin terminal inserting hole 1*b*. It is also possible to provide a rotation type locking mechanism between the middle portion 4*c* and the pin terminal inserting hole 1*b*. Furthermore, a threaded free end of the pin terminal 4*a* may be protruded from the bottom of the holder 1 and a cap nut made of a synthetic resin may be screwed to the threaded free end of the pin terminal 4*a* to fix the through pin 4 to the holder 1. Alternatively, a suitable cover may be provided on the holder 1 or the through pin 4 may be fixed by winding a tape around an assembly of the holder 1.

Embodiment 2

Figure 7:
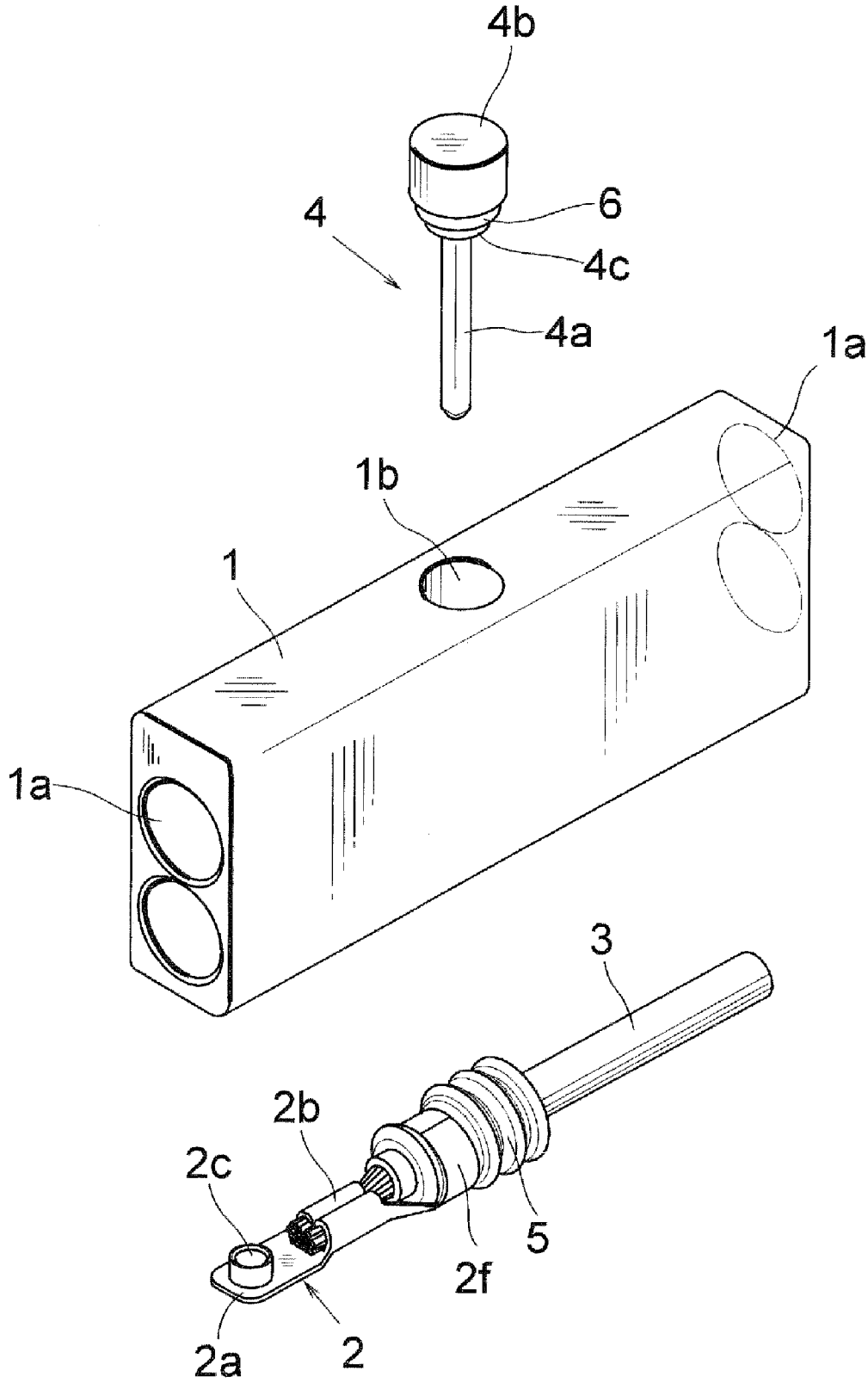
FIG. 7 is an exploded perspective view illustrating a second embodiment 2.
Figure 8:
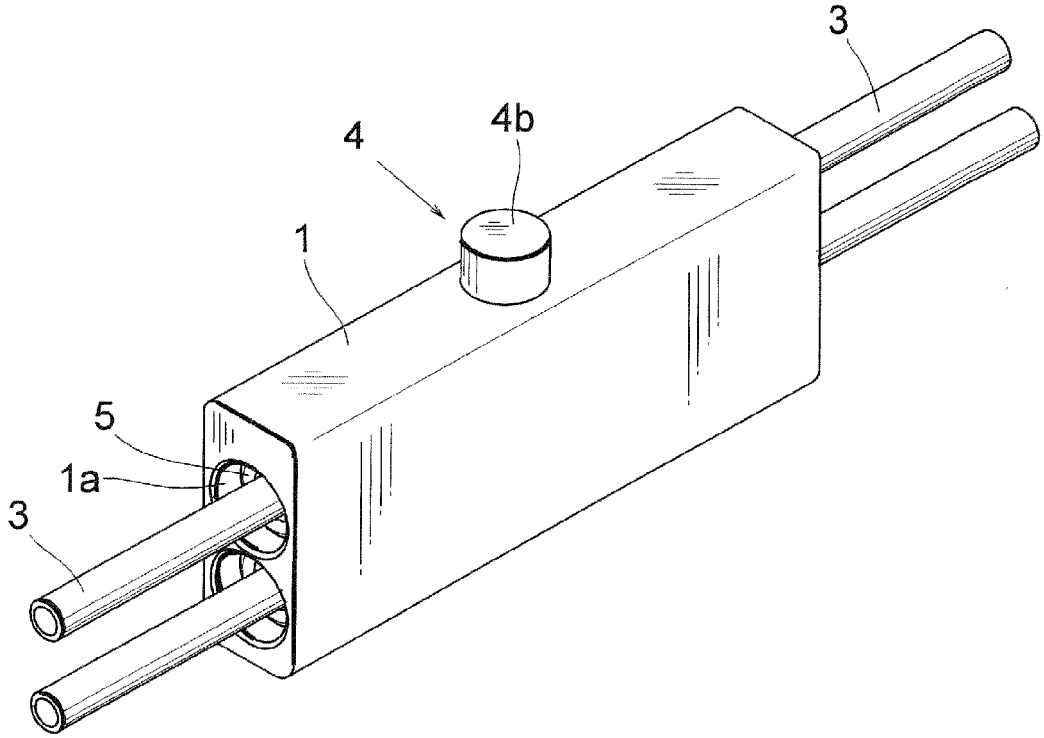
FIG. 8 is a perspective view showing an assembly.
Figure 9:
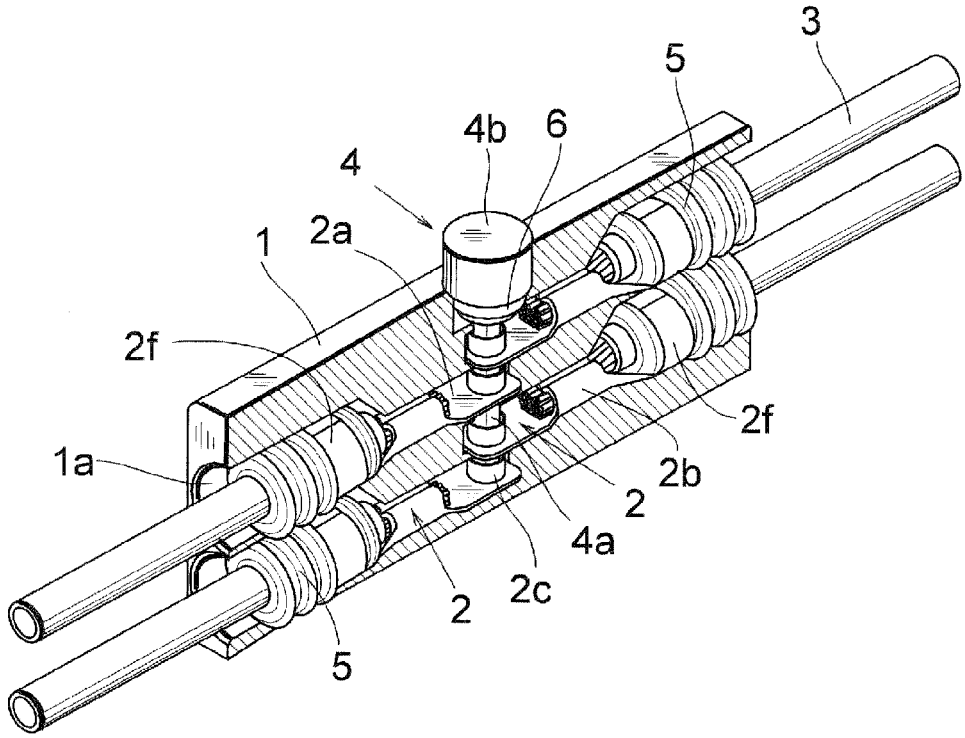
FIG. 9 is a partially cut-out perspective view illustrating the assembly.

FIG. 7 is a perspective view showing a waterproof type assembly of the holder 1, wire terminals 2 and through pin 4. FIG. 8 is a perspective view of the assembly and FIG. 9 is a cross sectional view of the assembly.

A circular waterproof sealing member 5 made of synthetic rubber is provided on the electric wire 3 and is fixed by a seal clamping portion 2*f* formed on the wire terminal 2. The wire terminal inserting hole 1*a* formed in the holder 1 has a circular inlet such that the wire terminal inserting hole 1*a* can be sealed by the waterproof sealing member 5 upon insertion of the wire terminal.

On the middle portion 4*c* of the through pin 4 there is also fixed a waterproof sealing member 6 having a tubular shape. Upon inserting the through pin 4 into the pin terminal inserting hole 1*b* having a circular inlet, the pin terminal inserting hole 1*b* is sealed by the waterproof sealing member 6.

As described above, in the second embodiment 2, the waterproof sealing members 5 and 6 can effectively prevent water from introducing into the holder 1. Such a waterproof structure may be preferably used in door harness, engine room harness and tail lamp harness of an automobile harness circuit, said harnesses requiring a waterproof property.

It should be noted that in the first and second embodiments 1 and 2, the holder 1 contains four wire terminal inserting holes 1*a* and four wire terminals 2 are inserted into these wire terminal inserting holes 1*a*, much more wire terminal inserting holes 1*a* may be formed in the holder 1 such that these holes aligned in a vertical direction. In this case, even if a plurality of wire terminal inserting holes 1*a* are formed on respective side walls of the holder 1 in a single column, a part of wire terminals 2 may be electrically connected to form one circuit by a first through pin 4 inserted into the holder 1 from a top wall of the holder and a remaining wire terminals may be electrically connected to form a separate circuit by a second through pin 4 inserted into the holder 1 from a bottom wall of the holder. In this case, a length of the pin terminals 4*a* of the through pins 4 should be selected such that free ends of the pin terminals 4*a* do not protrude beyond a horizontal center line of the holder 1. In this manner, two groups of conduction circuits may be obtained.

Moreover, an electric wire may be connected to the pin terminal 4*a*. Then the number of conduction circuits connected to the wire terminals 2 may be further increased.

What is claimed is:

1. A connecting member comprising:

a holder made of synthetic resin and having a plurality of wire terminal inserting holes and an insertion terminal inserting hole which crosses with said wire terminal inserting holes within the holder;

wire terminals each having a receptacle connecting end at one end, and each being adapted to have an electric wire connected thereto at the other end, wherein said wire terminals are adapted to be inserted into said wire terminal inserting holes;

an insertion terminal which is adapted to be inserted into said insertion terminal inserting hole and into contacts of the receptacle connecting ends of the wire terminals after the wire terminals are inserted into said wire terminal inserting holes;

wherein said contacts of the receptacle connecting ends of the wire terminals comprise one of a cylindrical portion and a hole portion; and wherein shapes of said contacts of the receptacle connecting ends and a lateral cross section of said inserting terminal are different such that one is rectangular and the other is circular for plastic deformation of said contacts of the receptacle connecting ends when the insertion terminal is inserted therein.

2. The connecting member according to claim 1, wherein a free end of said insertion terminal has a conical or truncated conical shape.

3. The connecting member according to claim 2, wherein said insertion terminal has a grip portion at an end opposite the free end.

4. The connecting member according to claim 1, wherein a sealing member made of rubber is provided on each of said wire terminals and a waterproof structure is formed between the wire terminals and the wire terminal inserting hole.

5. The connecting member according to claim 4, wherein a sealing member made of rubber is provided on said insertion terminal at a root thereof and a waterproof structure is formed between the insertion terminal and the insertion terminal inserting hole.

6. An automobile harness circuit including the connecting member recited in claim 1.

7. The connecting member according to claim 1, wherein a sealing member made of rubber is provided on said insertion terminal at a root thereof and a waterproof structure is formed between the insertion terminal and the insertion terminal inserting hole.

8. The connecting member according to claim 1, wherein at least one of the wire terminal inserting holes extends from a right side wall of the holder toward a center of the holder, and at least one of the wire terminal inserting holes extends from a left side wall of the holder toward the center of the holder, and wherein the wire terminal inserting holes on the right side wall are formed at a different level than the wire terminal inserting holes on the left side wall.

* * * * *